US006184185B1

(12) United States Patent
Taguchi et al.

(10) Patent No.: US 6,184,185 B1
(45) Date of Patent: Feb. 6, 2001

(54) LUBRICANT OIL COMPOSITION COMPRISING BORATED CYCLIC CARBOXYLIC ACID IMIDE

(75) Inventors: Shigeko Taguchi; Hiroshi Nakanishi; Takanori Kugimiya, all of Saitama (JP)

(73) Assignee: Tonen Corporation, Saitama (JP)

( * ) Notice: Under 35 U.S.C. 154(b), the term of this patent shall be extended for 0 days.

(21) Appl. No.: 09/285,579

(22) Filed: Apr. 2, 1999

(30) Foreign Application Priority Data

May 8, 1998 (JP) ..... 10-142194

(51) Int. Cl.[7] ..... C10M 139/00; C10M 155/04
(52) U.S. Cl. ..... 508/192
(58) Field of Search ..... 508/192

(56) References Cited

U.S. PATENT DOCUMENTS

| | | | | |
|---|---|---|---|---|
| 4,741,848 | * | 5/1988 | Koch et al. . | |
| 5,064,546 | | 11/1991 | Dasai | 252/32.5 |
| 5,110,488 | | 5/1992 | Tipton et al. | 252/32.7 E |
| 5,360,562 | | 11/1994 | Chrisope et al. | 252/46.6 |

FOREIGN PATENT DOCUMENTS

| | | | | |
|---|---|---|---|---|
| 0544298A1 | | 6/1993 | (EP) | C10M/163/00 |
| 0699738A1 | | 3/1996 | (EP) | C10M/133/44 |
| 05105892 | | 4/1993 | (JP) | C10M/129/10 |
| 06271883 | * | 9/1994 | (JP) . | |
| 08319494 | | 12/1996 | (JP) | C10M/161/00 |
| WO96/37584 | | 11/1996 | (WO) | C10M/141/06 |

* cited by examiner

*Primary Examiner*—Jerry D. Johnson
(74) *Attorney, Agent, or Firm*—Joseph J. Allocca; Joseph J. Dvorak

(57) ABSTRACT

The present invention provides a lubricant oil composition for an automatic and continuously variable transmission with a built-in torque converter equipped with a lock-up clutch, which is incorporated, in the base oil, with a compound containing at least one type of cyclic carboxylic acid imide having boron in the molecule and substituted by an alkyl or alkenyl group, wherein the cyclic carboxylic acid imide is contained at 0.1 to 12 wt % based on the whole composition.

4 Claims, No Drawings

LUBRICANT OIL COMPOSITION COMPRISING BORATED CYCLIC CARBOXYLIC ACID IMIDE

BACKGROUND OF THE INVENTION

1. Field of The Invention

This invention relates to a lubricant oil composition, more particularly, the composition characterized by high transmission torque capacity and good anti-shudder property, and useful for an automatic and continuously variable transmission (e.g., belt or traction type) with a built-in torque converter equipped with a lock-up clutch, the transmission being used in an automobile.

2. Description of The Related Art

A lubricant oil for an automatic or continuously variable transmission can be used in an automobile equipped with a torque converter, gear and hydraulic mechanisms, wet type clutch, and so on. This type of lubricant is required to have a variety of properties, because it functions as the power transmission medium for the torque converter, and hydraulic and control systems; as the lubricant and temperature-controlling medium for the gears, bearings, wet type clutch, and so on; and as the lubricant medium and the medium to maintain the function-related characteristics of the friction material, in order to smoothly operate the transmission.

Recently, lock-up clutches have been built in torque converters in many automobiles to improve mileage. In this mechanism, a transmission is built in a torque converter. A lock-up clutch is a device that directly transmits the engine driving force to the transmission under varying running conditions. Torque converter efficiency can be enhanced, when switching between torque converter driving and direct driving is well timed.

However, a conventional lock-up clutch mechanism works only in a high speed range, and not in a low speed range where engine torque widely varies.

Recently, slip control is adopted to help the lock-up clutch work in the low speed range of an automatic transmission. However, abnormal vibration of the car body, known as shudder, has been frequently observed at the lock-up clutch's surface, when the lock-up mechanism is operated in a low speed range. Such a phenomenon is more pronounced, when coefficient of friction decreases as relative sliding velocity increases at the slip-controlled lock-up clutch. In order to prevent the shudder phenomenon, the lubricant is required to have good $\mu$(coefficient of friction)–V (sliding velocity) characteristics. In other words, it is required to have a coefficient of friction which increases as sliding velocity increases, i.e., positive $\mu$–V relationship, for an automatic and continuously variable transmission.

Esters of phosphates, aliphatic acids and fatty amides have been proposed as friction modifiers for automatic transmission lubricants, as disclosed by Japanese Laid-open Patent application No. 63-254196. However, these modifiers have disadvantages which result in a decreasing coefficient of friction at the lock-up clutch in a low sliding velocity range, and in insufficient transmission torque when the clutch is connected.

Use of metallic detergents and ashless depressants has been proposed, as disclosed by Japanese Laid-open Patent application Nos. 5-105892, 6-271883, 8-127789 and 8-319494, to increase transmission torque capacity. Nevertheless, however, few lubricants have exhibited sufficient friction-related properties, even in the presence of the above additives.

As discussed above, the $\mu$–V characteristics trade off with transmission torque capacity, and it is necessary to increase transmission torque capacity while keeping a positive $\mu$–V relationship. As a result, there have been demands increasingly for the technique to increase coefficient of friction in a high sliding velocity.

DESCRIPTION OF THE INVENTION

It is an object of the present invention to provide a lubricant oil composition for an automatic and continuously variable transmission, which exhibits a sufficient coefficient of friction in a high sliding velocity range in an automatic and continuously variable transmission with a built-in torque converter equipped with a lock-up clutch.

It has been discovered that the lubricant composition for an automatic and continuously variable transmission exhibits a sufficient coefficient of friction in a high sliding velocity range while keeping the lubricant characteristics required by these transmissions, when the lubricant base oil is incorporated with an adequate but minor quantity of an additive which contains at least one type of cyclic carboxylic acid imide having boron in the molecule and substituted by hydrocarbyl groups selected from the group consisting of alkyl group(s), alkenyl group(s), and mixtures thereof.

The present invention provides a lubricant oil composition for an automatic and continuously variable transmissions equipped with a slip-controlled, lock-up clutch, which exhibits a sufficient coefficient of friction in a high sliding velocity range by incorporating in the base oil an additive which contains at least one type of cyclic carboxylic acid imide, containing a specific boron species in the molecule and substituted by hydrocarbyl group(s) selected from the group consisting of alkyl or alkenyl group(s) and mixtures thereof.

The present invention relates, as described above, to a lubricant oil composition comprising a major amount of a base oil incorporated with a minor amount of specific additive. Some of the preferred embodiments are described below:

(1) A lubricant oil composition for an automatic and continuously variable transmission, characterized by incorporating in the base oil at least one type of cyclic dicarboxylic acid imide having boron in the molecule and substituted by alkyl and/or alkenyl group(s), at 0.1 to 12 wt % based on the whole composition.

(2) A lubricant oil composition for an automatic and continuously variable transmission, characterized by incorporating in the base oil at least one type of cyclic dicarboxylic acid imide, shown by one of the general formulae (1) through (4) described below, having boron in the molecule, at 0.1 to 12 wt % based on the whole composition.

(3) A lubricant oil composition for an automatic and continuously variable transmission as described in (1) or (2) above, wherein the hydrocarbyl group substituted onto the boron containing cyclic carboxylic acid imide is an alkyl or alkenyl group having a carbon number of 6 to 300 (molecular weight of 80 to 4200).

(4) A lubricant oil composition for an automatic and continuously variable transmission as described in (1) to (3) above, wherein B/N ratio, i.e., the molar ratio of boron to nitrogen in the cyclic dicarboxylic acid imide is 0.01 to 0.5.

(5) A lubricant oil composition for an automatic and continuously variable transmission, containing the above composition, is further incorporated with at least one type of additives selected from the group consisting of viscosity index improver, pour depressant, ashless dispersant, metallic detergent, oxidation inhibitor, wear inhibitor, extreme-pressure agent, metal deactivator, corrosion inhibitor, anti-foaming agent and other additives required for the lubricant oil composition for an automatic and continuously variable transmission.

THE PRESENT INVENTION

The present invention is described in more detail, below:

(1) Lubricant Base Oil

The base oil for the lubricant oil composition of the present invention for an automatic and continuously variable transmission is not limited, and any oil commonly used as a base oil can be used. It may be a mineral or synthetic oil, or a mixture thereof.

The mineral oil may be a raffinate derived from a naphthenic or paraffinic crude oil, where the lubricant stock from the atmospheric or vacuum residue is extracted with an adequate aromatic solvent, e.g., phenol, furfural or N-methylpyrrolidone to produce the raffinate. It may be a hydrotreated oil, derived from the above lubricant stock which is subjected to a hydrotreatment process including hydrocracking, or isomerate obtained by bringing wax into contact with hydrogen under isomerization conditions in the presence of an isomerization catalyst. It may be also a lubricant fraction which is treated by solvent extraction combined with hydrotreating and/or isomerization. In each case, one or more additional processes, e.g., dewaxing, hydrofinishing and clay treatment effected under known conditions, may be optionally used. The examples of mineral base oils include light, medium and heavy neutral oils, and bright stock, which can be mixed with each other, as adequate, to satisfy the required properties.

The examples of synthetic base oils include poly-alpha-olefin, alpha-olefin oligomer, polybutene, alkylbenzene, polyol ester, dibasic acid ester, polyoxyalkylene glycol, polyoxyalkylene glycol ether, and silicone oil.

These base oils may be used individually or in combination. A mineral oil may be combined with a synthetic oil. The base oil for the present invention generally has a kinematic viscosity of 2 to 20 $mm^2/s$ at 100° C., preferably 3 to 15 $mm^2/s$. Viscosity beyond the above range causes problems, e.g., insufficient viscosity at low temperature when it exceeds the above range, and increased friction at sliding members (e.g., a gear, bearing and clutch in an automatic transmission) when it is below the above range.

(2) Additive Component

Examples of the cyclic dicarboxylic acid imide as the essential component for the lubricant oil composition of the present invention, having boron in the molecule and substituted with one or more alkyl and/or alkenyl group(s), capable of increasing coefficient of friction of the lubricant oil composition in a high sliding velocity range, include boron compounds of 3,6-methylene cyclohexyl-1,2-dicarboxylic acid imides (mono- and bis-), boron compounds of 2-alkyl-3,6-dimethylene cyclohexyl-1,2-dicarboxylic acid imides (mono- and bis-), boron compounds of endo-bicyclo-(2,2,1)-5-heptene-2,3-dicarboxylic acid imides (mono- and bis-), boron compounds of cyclohexyl-1,2-dicarboxylic acid imides (mono- and bis-), boron compounds of cis-4-cyclohexene-1,2-dicarboxylic acid imides (mono- and bis-), boron compounds of alkylcyclohexyl-1,2-dicarboxylic acid imides (mono- and bis-), boron compounds of phyhalimides (mono- and bis-), boron compounds of succinimides (mono- and bis-), boron compounds of maleinimides (mono- and bis-), boron compounds of glutamimides (mono- and bis-), boron compounds of glutaconimide(mono- and bis-), boron compounds of adipimides (mono- and bis-), boron compounds of itaconimides (mono- and bis-), and citraconimides (mono- and bis-), all substituted with an alkyl or alkenyl group. Of these, particularly useful compounds are the cyclic dicarboxylic acid imides substituted by an alkyl or alkenyl group, shown by the following general formulae:

General Formula (1)

A boron compound of (a)

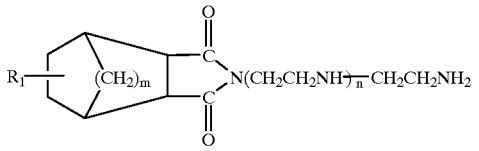

and/or a boron compound of (b)

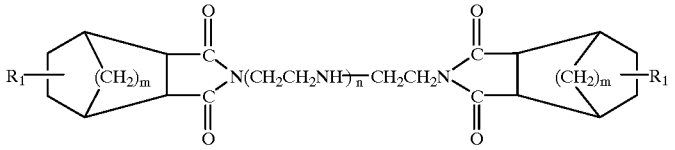

wherein, R is alkyl and/or alkenyl group, and l, m and n are each an integer of 1 to 2, 1 to 4 and 0 to 15, respectively.

Shown by the general formula (1) are boron compounds of 3,6-methylene cyclohexyl-1,2-dicarboxylic acid imides anhydride (mono- (a) and bis- (b)) substituted by an alkyl or alkenyl group, wherein the alkyl or alkenyl group represented by R has a carbon number of 6 to 300, preferably 8 to 120. The additive may be dissolved in the base oil insufficiently, when the carbon number is below 6 or above 300. The R group has a molecular weight of 80 to 4200, preferably 110 to 1700. The cyclic dicarboxylic acid imide may be dissolved in the base oil insufficiently, when the molecular weight of the R group is below 80 or above 4200. For the alkyl or alkenyl group, 1 is an integer of 1 to 2. The preferable position of the substituent is the 4- or 5-site. For the methylene group, m is an integer of 1 to 4, preferably 1 to 2.

The polyamine represented by $(CH_2CH_2NH)_n$ in the general formula (1) may be cyclic, straight-chain or branched.

In the boron compound shown by the general formula (1), boron is included at a B/N ratio of 0.005 to 1, preferably 0.01 to 0.5, wherein B/N ratio stands for molar ratio of boron to nitrogen in the cyclic dicarboxylic acid imide.

General Formula (2)

A boron compound of (a)

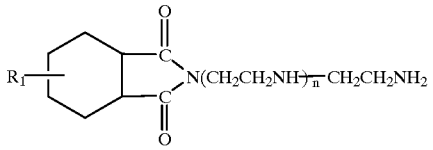

and/or a boron compound of (b)

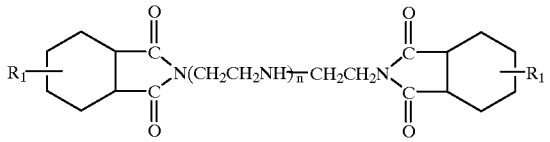

wherein, R is alkyl and/or alkenyl group(s), and l and n are each an integer of 1 to 4 and 0 to 15, respectively.

Shown by the general formula (2) are boron compounds of cyclohexyl-1,2-dicarboxylic acid imides (mono- (a) and bis- (b)) substituted by an alkyl or alkenyl group, wherein the alkyl or alkenyl group represented by R has a carbon number of 6 to 300, preferably 8 to 120. The additive may be dissolved in the base oil insufficiently, when the carbon number is below 6 or above 300. The R group has a molecular weight of 80 to 4200, preferably 110 to 1700. The additive may be dissolved in the base oil insufficiently, when the molecular weight of the R group is below 80 or above 4200. For the alkyl or alkenyl group, 1 is an integer of 1 to 4, preferably 1 to 2. The preferable position of the substituent is the 4- or 5-site.

The polyamine represented by $(CH_2CH_2NH)_n$ in the general formula (2) may be cyclic, straight-chain or branched.

In the boron compound shown by the general formula (2), boron is included at a B/N ratio of 0.005 to 1, preferably 0.01 to 0.5, wherein B/N ratio stands for molar ratio of boron to nitrogen in the cyclic dicarboxylic acid imide.

General Formula (3)

A boron compound of (a)

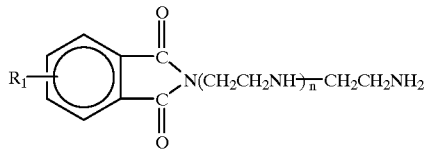

and/or

A boron compound of (b)

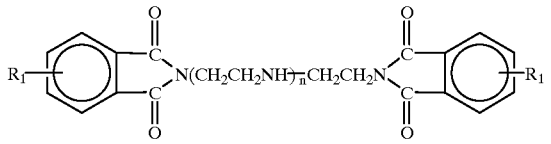

wherein, R is one or more alkyl and/or alkenyl group(s), and l and n are each an integer of 1 to 4 and 0 to 15, respectively.

Shown by the general formula (3) are boron compounds of phyhalimides (mono- (a) and bis- (b)) substituted by an alkyl or alkenyl group, wherein the alkyl or alkenyl group represented by R has a carbon number of 6 to 300, preferably 8 to 120. The additive may be dissolved in the base oil insufficiently, when the carbon number of the R group is below 6 or above 300. The R group has a molecular weight of 80 to 4200, preferably 110 to 1700. It may be dissolved in the base oil insufficiently, when the molecular weight of the R group is below 80 or above 4200. For the alkyl or alkenyl group, 1 is an integer of 1 to 4, preferably 1 to 2. The preferable position of the substituent is the 4- or 5-site. The polyamine represented by $(CH_2CH_2NH)_n$ in the general formula (3) may be cyclic, straight-chain or branched.

In the boron compound shown by the general formula (3), boron is included at a B/N ratio of 0.005 to 1, preferably 0.01 to 0.5, wherein B/N ratio stands for molar ratio of boron to nitrogen in the cyclic dicarboxylic acid imide.

General Formula (4)

A boron compound of (a)

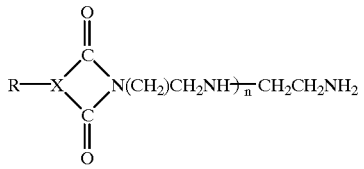

and/or a boron compound of (b)

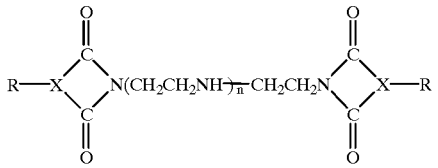

wherein, R is an alkyl or alkenyl group, X is $C_pH_{2p-1}$ or $C_pH_{2p-3}$, and p and n are each an integer of 2 to 11 and 0 to 15, respectively.

The alkyl or alkenyl group represented by R in the general formula (4) above has a carbon number of 6 to 300, preferably 8 to 120. The additive may be dissolved in the base oil insufficiently, when the carbon number of the R group is below 6 or above 300. The additive has a molecular weight of 80 to 4200, preferably 110 to 1700. The additive may be dissolved in the base oil insufficiently, when the molecular weight of the R group is below 80 or above 4200.

The polyamine represented by $(CH_2CH_2NH)_n$ in the general formula (4) may be cyclic, straight-chain or branched.

In the boron compound shown by the general formula (4), boron is included at a B/N ratio of 0.005 to 1, preferably 0.01 to 0.5, wherein B/N ratio stands for molar ratio of boron to nitrogen in the cyclic dicarboxylic acid imide.

The lubricant base oil is incorporated with the compound containing at least one type of the cyclic dicarboxylic acid imide having boron in the molecule and substituted by an alkyl or alkenyl group, at 0.1 to 12 wt %, preferably 0.1 to 11 wt %, based on the whole composition. The lubricant oil composition may have insufficient anti-shudder property when its content is below 0.1 wt %, and insufficient oxidation stability and also insufficient effect of improving friction-related properties when it is above 12 wt %.

The lubricant oil composition of the present invention contains the above additive as the essential component, to bring the effect of notably improving coefficient of friction in a high sliding velocity range, when used in an automatic or continuously variable transmission.

The base oil for the lubricant oil composition of the present invention may be incorporated with any additive as the friction modifier other than the cyclic dicarboxylic acid imide having boron in the molecule and substituted by an alkyl or alkenyl group, so long as it causes no damage of the essential object of the present invention, i.e., improving coefficient of friction in a high sliding velocity range.

The friction modifiers, other than the cyclic dicarboxylic acid imide having boron in the molecule and substituted by an alkyl or alkenyl group as the essential component for the lubricant oil composition of present invention, may be optionally used. Such compounds include molybdenum dithiophosphate, molybdenum dithiocarbamate, a phosphate ester, phosphite ester, amine salt of phosphate ester, fatty acid, higher alcohol, fatty acid ester, oil and fat, polyalcohol ester, sorbitan ester, and amine-, amide and imide-based compounds. These compounds capable of modifying friction, which generally function to decrease coefficient of friction in any sliding velocity range, can increase coefficient of friction in a high sliding velocity range without greatly decreasing coefficient of friction in a low sliding velocity range, and make the $\mu$–V relationship positive, when combined with the cyclic dicarboxylic acid imide having boron in the molecule and substituted by an alkyl or alkenyl group as the essential component for the lubricant oil composition of the present invention. Of these, an amide- and imide-based compound improve friction-related characteristics more notably, when combined with the cyclic dicarboxylic acid imide having boron in the molecule and substituted by an alkyl or alkenyl group.

(3) Other Additive Components

The lubricant oil composition of the present invention, containing the above compound as the essential component in the base oil, may be incorporated, as adequate, with another type of additive, e.g., viscosity index improver, pour depressant, ashless dispersant, metallic detergent, oxidation inhibitor, wear inhibitor, extreme-pressure agent, metal deactivator, corrosion inhibitor, anti-foaming agent or colorant, so long as it causes no damage of the objective of the present invention.

Examples of the viscosity index improver useful for the present invention generally include compounds based on polymethacrylates, olefin copolymers (polyisobytylene- and ethylene-propylene copolymer-based compounds), polyalkyl styrenes, hydrogenated styrene-butadiene copolymers, styrene-anhydrous maleate esters. For example, polymethacrylate-based compounds are preferably used. They are normally contained at 3 to 35 wt %.

Examples of the pour depressant useful for the present invention generally include ethylene-vinyl acetate copolymers, condensation products of chlorinated paraffin and naphthalene, condensation products of chlorinated paraffin and phenol, polymethacrylate, and polyalkyl styrene. For example, polymethacrylates are preferably used. They are normally contained at 0.01 to 5 wt %.

Example of the ashless dispersant useful for the present invention include compounds based on polyalkenylsuccinic acid amides, benzylamine, succinate ester-amides. They are normally contained at 0.1 to 10 wt %.

Examples of the metallic detergent useful for the present invention include sulfonates, phenates, salicylates and phosphonates of Ca, Mg and Ba. They are normally contained at 0.05 to 5 wt %.

Examples of the oxidation inhibitor useful for the present invention generally include amine-based ones (e.g., alkylated diphenylamines, phenyl-$\mu$-naphthyl amines and alkylated phenyl-$\mu$-naphthyl amines); phenol-based ones [e.g., 2,6-ditertiary butyl phenol and 4,4'-methylenebis-(2,6-ditertiary butyl phenol)]; sulfur-based ones (e.g., dilauryl-3, 3'-dithiopropionate); phosphorus-based ones (e.g., phosphites); and zinc dithiophosphates. For example, amine- and phenol-based ones are preferably used. They are normally contained at 0.05 to 5 wt %.

Examples of the wear inhibitor useful for the present invention generally include metal salts of dithiophosphoric acid (e.g., those of Zn, Pb, Sb and Mo), metal salts of dithiocarbamic acid (e.g., those of Zn and Mo), metal salts of naphthenic acid (e.g., those of Pb), metal salts of fatty acid (e.g., those of Pb), sulfurized oil and fat, sulfur compounds, boron compounds, phosphate esters, phosphite esters, and amine salts of phosphate esters. For example, metal salts of phosphate esters and dithiophosphate esters are preferably used. They are normally contained at 0.05 to 5 wt %.

Examples of the extreme-pressure agent useful for the present invention include sulfurized oil and fat, dibenzyl sulfide, dibutyl disulfide, zinc dithiphosphate, phosphate esters, phosphite esters and amine salts of phosphate esters. They are normally contained at 0.05 to 3 wt %.

Examples of the metal deactivator useful for the present invention include benzotriazole, and derivatives of triazole, benzotriazole and thiadiazole. They are normally contained at 0.001 to 3 wt %.

The lubricant oil composition of the present invention may be also incorporated, as required, with another type of additive, e.g., corrosion inhibitor, anti-foaming agent or colorant.

The preferable and acceptable content ranges (wt %), based on the whole composition, of the above additives are given below:

| | Preferable Content Range (wt %) | Acceptable Content Range (wt %) |
|---|---|---|
| Viscosity index improver | 4~30 | 3~35 |
| Pour depressant | 0.5~3 | 0.01~5 |
| Ashless dispersant | 0.1~5 | 0.1~10 |
| Metallic detergent | 0.1~3 | 0.05~5 |
| Oxidation inhibitor | 0.1~3 | 0.05~5 |
| Wear inhibitor | 0.1~2 | 0.05~5 |
| Extreme-pressure agent | 0.1~2 | 0.05~5 |
| Metal deactivator | 0.01~2 | 0.001~3 |
| Corrosion inhibitor | 0.01~5 | 0.01~10 |
| Anti-foaming agent | 0.0001~1 | 0.0001~2 |

The present invention is described in more detail by the following Examples and Comparative Examples, which by no means limit the present invention. Coefficient of friction described in Examples and Comparative Examples was determined by the following method:

(1) Measurement of Coefficient of Friction

Coefficient of friction was determined by an anti-shudder performance tester for automatic transmission oil, as specified by JASO M349-95.

TEST CONDITIONS

Specimen: A friction plate (friction material, SD-1777) and steel plate, as specified by JASO M349-95.

Pre-treatment conditions: The friction plate specimen was immersed in the lubricant oil composition for 30 minutes, and then rotated at 80° C. as oil temperature, 1 MPa as surface pressure and 100 rpm for 30 minutes, while kept in contact with the steel plate.

Test: The pre-treated specimen was further immersed in the oil for 30 minutes, and tested under the following conditions:

Oil quantity: 100 cc

Oil temperature: 100° C.

Surface pressure: 1.0 MPa

Rotational speed (high sliding velocity): 300 rpm $\mu$300: Coefficient of friction at a rotational speed of 300 rpm Method for determining coefficient of friction: Coefficient of friction was the level observed 2 seconds after the test was started under the set of conditions, as specified by JASO M349-95.

(2) Assessment Method

The friction plate was rotated on the stationary steel plate at a given load, to determine the torque (coefficient of friction) evolved. It is considered that transmission torque capacity increases as coefficient of friction increases.

EXAMPLES AND COMPARATIVE EXAMPLES

Examples 1 and 2

A solvent-refined, paraffinic mineral oil (kinematic viscosity: 4 $mm^2$s at 100° C.) was used as the base oil. It was incorporated with 5.0 wt % (based on the whole composition) of a cyclic carboxylic acid imide shown by the general formula (1), containing a mono type boron compound in the molecule and substituted by an alkenyl group having a molecular weight of 600 in Example 1, and with 10.0 wt % (based on the whole composition) of a cyclic carboxylic acid imide shown by the general formula (1), containing a bis type boron compound in the molecule and substituted by an alkenyl group having a molecular weight of 1000 in Example 2. These lubricant oil compositions were tested at the high sliding velocity, to determine their coefficients of friction. The results are given in Table 1. The composition prepared in Example 1 had a coefficient of friction of 0.158, and that prepared in Example 2 had a coefficient of 0.164.

Examples 3 to 8

Each of the lubricant base oils shown in Table 1 was incorporated with the additive shown in the table at the concentration, also given in the table. These lubricant oil compositions were tested at the high sliding velocity, to determine their coefficients of friction. The results are given in Table 1.

Comparative Examples 1 to 11

Each of the lubricant base oils shown in Table 2 was incorporated with the additive shown in the table at the concentration, also given in the table. These lubricant oil compositions were tested at the high sliding velocity, to determine their coefficients of friction. The results are given in Table 2.

TABLE 1

| Lubricant Oil Compositions (wt %) | Example 1 | Example 2 | Example 3 | Example 4 | Example 5 | Example 6 | Example 7 | Example 8 |
|---|---|---|---|---|---|---|---|---|
| Base Oil | | | | | | | | |
| Paraffinic mineral oil | Balance | Balance | Balance | Balance | Balance | Balance | Balance | Balance |
| Additives | | | | | | | | |
| Cyclic carboxylic acid imides having boron in the molecule | | | | | | | | |
| Shown by the general formula (1), mono type | 5.0 | — | — | — | — | — | — | — |
| Shown by the general formula (1), bis type | — | 10.00 | — | — | — | — | — | — |
| Shown by the general formula (2), mono type | — | — | 5.0 | — | — | — | — | — |
| Shown by the general formula (2), bis type | — | — | — | 5.0 | — | — | — | — |
| Shown by the general formula (3), mono type | — | — | — | — | 5.0 | — | — | — |
| Shown by the general formula (3), bis type | — | — | — | — | — | 5.0 | — | — |
| Shown by the general formula (4), mono type | — | — | — | — | — | — | 2.5 | — |
| Shown by the general formula (4), bis type | — | — | — | — | — | — | — | 5.0 |
| Anti-Shudder Property | | | | | | | | |
| Coefficient of friction, determined at 100° C. and 1 MPA Viscosity at the high sliding velocity ($\mu_H$) $\mu_{300}$ | 0.158 | 0.164 | 0.142 | 0.136 | 0.132 | 0.140 | 0.155 | 0.160 |

The general formula (1), mono type: R: an alkenyl group having a molecular weight of 600, 1: 1, m: 1, n: 3, and a boron compound having a B/N ratio of 0.3

The general formula (1), bis type: R: an alkenyl group having a molecular weight of 1000, 1: 1, m: 1, n: 9 on the average (distributed in a range from 3 to 15), and a boron compound having a B/N ratio of 0.5

The general formula (2), mono type: R: an alkenyl group having a molecular weight of 2900, 1: 1, n: 3, and a boron compound having a B/N ratio of 0.1

The general formula (2), bis type: R: an alkenyl group having a molecular weight of 1000, 1: 1, n: 3, and a boron compound having a B/N ratio of 0.05

The general formula (3), mono type: R: an alkyl group having a molecular weight of 113, 1: 2, n: 3, and a boron compound having a B/N ratio of 0.3

The general formula (3), bis type: R: an alkyl group having a molecular weight of 281, 1: 1, n: 3, and a boron compound having a B/N ratio of 0.3

The general formula (4), mono type: R: an alkenyl group having a molecular weight of 1000, n: 9 on the average (distributed in a range from 3 to 15), and a boron compound of succinic acid imide having a B/N ratio of 0.02

The general formula (4), bis type: R: an alkyl group having a molecular weight of 113, n: 3, and a boron compound of succinic acid imide having a B/N ratio of 0.3

TABLE 2

| Lubricant Oil Compositions (wt %) | Comparative Examples 1 | 2 | 3 | 4 | 5 | 6 |
|---|---|---|---|---|---|---|
| Base Oil | | | | | | |
| Paraffinic mineral oil | 100 | Balance | Balance | Balance | Balance | Balance |
| Additives | | | | | | |
| Cyclic carboxylic acid imides containing no boron in the molecule | | | | | | |
| Shown by the general formula (1), mono type | — | 5.0 | — | — | — | — |
| Shown by the general formula (1), bis type | — | — | 10 | — | — | — |
| Shown by the general formula (2), mono type | — | — | — | 5.0 | — | — |
| Shown by the general formula (2), bis type | — | — | — | — | 5.0 | — |
| Shown by the general formula (3), mono type | — | — | — | — | — | 5.0 |
| Sbown by the general formula (3), bis type | — | — | — | — | — | — |
| Shown by the general formula (4), mono type | — | — | — | — | — | — |
| Shown by the general formula (4), bis type | — | — | — | — | — | — |
| Polyisobutylenes | | | | | | |
| MW1000 | — | — | — | — | — | — |
| MW2900 | — | — | — | — | — | — |
| Anti-Shudder Property | | | | | | |
| Coefficient of friction, determined at 100° C. and 1 MPa viscosity at the high sliding velocity ($\mu_H$) $\mu_{300}$ | 0.096 | 0.119 | 0.120 | 0.115 | 0.110 | 0.112 |

The general formula (1), mono type: R: an alkenyl group having a molecule weight of 600, 1: 1, m: 1, n: 3, and B.N ratio: 0
The general formula (1), bis type: R: an alkenyl group having a molecular weight of 1000, 1: 1, m: 1, n: 9 on the average (distributed in a range from 3 to 15), and B/N ratio: 0
The general formula (2), mono type: R: an alkenyl group having a molecular weight of 2900, 1: 1, n: 3, and B/N ratio: 0
The general formula (2), bis type: R: an alkenyl group having a molecular weight of 1000, 1: 1, n: 3, and B/N ratio: 0

| Lubricant Oil Compositions (wt %) | COMPARATIVE EXAMPLES 7 | 8 | 9 | 10 | 11 |
|---|---|---|---|---|---|
| Base Oil | | | | | |
| Paraffinic mineral oil | Balance | Balance | Balance | Balance | Balance |
| Additives | | | | | |
| Cyclic carboxylic acid imides containing no boron in the molecule | | | | | |
| Shown by the general formula (1), mono type | — | — | — | — | — |
| Shown by the general formula (1), bis type | — | — | — | — | — |
| Shown by the general formula (2), mono type | — | — | — | — | — |
| Shown by the general formula (2), bis type | — | — | — | — | — |
| Shown by the general formula (3), mono type | — | — | — | — | — |
| Shown by the general formula (3), bis type | 5.0 | — | — | — | — |
| Shown by the general formula (4), mono type | — | 4.0 | — | — | — |
| Shown by the general formula (4), bis type | — | — | 5.0 | — | — |
| Polyisobutylenes | | | | | |
| MW1000 | — | — | — | 5.0 | — |
| MW2900 | — | — | — | — | 5.0 |
| Anti-Shudder Property | | | | | |
| Coefficient of friction, determined at 100° C. and 1 MPa viscosity at the high sliding velocity ($\mu_H$) $\mu_{300}$ | 0.113 | 0.125 | 0.120 | 0.092 | 0.090 |

The general formula (3), mono type: R: an alkyl group having a molecular weight of 113, 1: 2, n: 3, and B/N ratio: 0
The general formula (3), bis type: R: an alkyl group having a molecular weight of 281, 1: 1, n: 3, and B/N ratio of: 0
The general formula (4), mono type: R: an alkenyl group having a molecular weight of 1000, n: 9 on the average (distributed in a range from 3 to 15), and a succinic acid imide having a B/N ratio of 0
The general formula (4), bis type: R: an alkyl group having a molecular weight of 113, n: 3, and a succinic acid imide having a B/N ratio of 0

It is generally accepted that a lubricant oil composition for an automatic and continuously variable transmission, with a built-in torque converter equipped with a lock-up clutch, has a positive $\mu$–V relationship by use of a compound capable of modifying viscosity to decrease coefficient of friction in a low sliding velocity range. However, decreased coefficient of friction in a low sliding velocity range results in decreased transmission torque capacity, which, however, is inconsistent with the development objective to secure a high transmission torque capacity. Therefore, there have been great demands for friction modifier compounds which can increase coefficient of friction in a high sliding velocity range without greatly decreasing the coefficient in a low sliding velocity range, and, at the same time, secure a positive $\mu$–V relationship. The development target has been set to obtain a lubricant oil composition which exhibits a coefficient of friction ($\mu_{300}$) above 0.130 at a high sliding velocity, as realized in Examples described in this specification.

Examples and Comparative Examples described in this specification show that the lubricant oil composition of this invention, incorporated with, as the essential component, a given concentration of a cyclic carboxylic acid imide having boron in the molecule and substituted by an alkyl or alkenyl group exhibits a high coefficient of friction at the high sliding velocity, satisfies the target set for the lubricant composition for an automatic and continuously variable transmission, and is of high-quality. Taking, as an example, the results of Example 1, the lubricant oil composition shows a coefficient of friction of 0.158 at the high sliding velocity, which is higher than the target of 0.130, and should exhibit excellent power transmission capacity. Similarly, the high-quality lubricant oil compositions for an automatic and continuously variable transmission are obtained in Examples 2 through 8.

On the other hand, the composition obtained by Comparative Example 1, which lacks the essential component for the present invention has a coefficient of friction of 0.096 at the high sliding velocity, which is below the target. Comparative Examples 2 and 3 use specific concentrations of cyclic carboxylic acid imides which are represented by the general formula (1) except that they contain no boron, although substituted by an alkyl or alkenyl group. The compositions prepared in these examples have respective coefficients of friction of 0.119 and 0.120 at the high sliding velocity, failing to satisfy the target coefficient similarly to that prepared in Comparative Example 1. Comparative Examples 4 and 5 use specific concentrations of cyclic carboxylic acid imides which are represented by the general formula (2) except that they contain no boron, although substituted by an alkyl or alkenyl group. The compositions prepared in these examples have respective coefficients of friction of 0.115 and 0.110 at the high sliding velocity, failing to satisfy the target coefficient similarly to those prepared in the Comparative Examples 1 to 3. Comparative Examples 6 and 7 use specific concentrations of cyclic carboxylic acid imides which are represented by the general formula (3) except that they contain no boron, although substituted by an alkyl or alkenyl group, and Comparative Examples 8 and 9 use specific concentrations of cyclic carboxylic acid imides which are represented by the general formula (4) except that they contain no boron, although substituted by an alkyl or alkenyl group (i.e., boron-free succinimides substituted by an alkenyl group, which are commonly incorporated in lubricant compositions). The compositions prepared by these examples fail to satisfy the target coefficient, similarly to those prepared by the Comparative Examples 1 to 5. Comparative Examples 10 and 11 use specific concentrations of polyisobutylenes instead of the essential component for the present invention, i.e., cyclic carboxylic acid imides having boron species in the molecule and substituted by an alkyl or alkenyl group. The compositions prepared in these examples fail to satisfy the target coefficient, similarly to those prepared by the Comparative Examples 1 to 9, because their coefficients of friction are 0.092 and 0.090, respectively, in a high sliding velocity range.

It is apparent, as described above, that a lubricant oil composition is not of high quality as the one for an automatic or continuously variable transmission, because of its insufficient coefficient of friction in a high sliding velocity range, unless it contains a cyclic carboxylic acid imide having boron in the molecule and substituted by an alkyl or alkenyl group, as the essential component for the present invention. In other words, it is possible to provide a high-quality lubricant oil composition by incorporating, in a lubricant base oil, a cyclic carboxylic acid imide (which is represented by succinimide) having boron in the molecule and substituted by an alkyl or alkenyl, in order to increase coefficient of friction in a high sliding velocity range, without greatly decreasing the composition in a low sliding velocity range.

What is claimed is:

1. A lubricant oil composition for increasing the coefficient of friction at a high sliding velocity of automatic and continuously variable transmissions equipped with a step-controller lock-up clutch, the composition comprising:

a major amount of a lubricant base oil and from 0.1 to 12 wt % based on the whole composition of an additive containing at least one type of cyclic carboxylic acid imide having boron in the molecule and substituted by hydrocarbyl group selected from the group consisting of alkyl groups, or alkenyl groups and mixtures thereof, the composition having a coefficient of friction above 0.130 as determined by test JASO M349-95.

2. The composition of claim 1, wherein said cyclic carboxylic acid imide having boron in the molecule and substituted by an alkyl or alkenyl group is represented by at least one of the general formulae (1) through (4):

general formula (1):

a boron compound of (a)

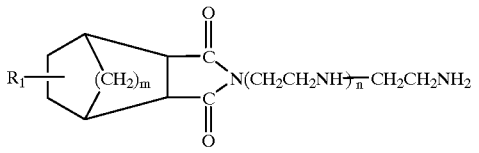

and/or a boron compound of (b)

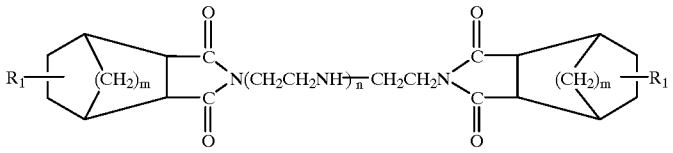

wherein, R is an alkyl or alkenyl group having a molecular weight of 80 to 4200 and carbon number of 6 to 300; l, m and n are each an integer of 1 to 2, 1 to 4 and 0 to 15, respectively, and $(CH_2CH_2NH)_n$ may be cyclic, straight-chain or branched, General Formula (2):

a boron compound of (a)

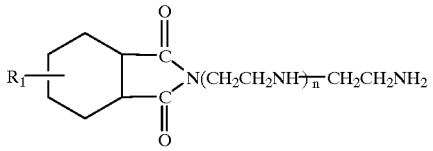

and/or a boron compound of (b)

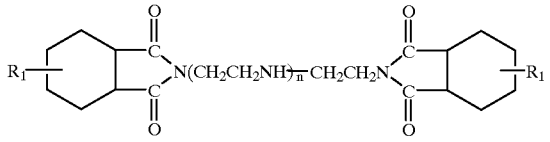

wherein, R is an alkyl or alkenyl group having a molecular weight of 80 to 4200 and carbon number of 6 to 300; l and n are each an integer of 1 to 4 and 0 to 15, respectively; and $(CH_2CH_2NH)_n$ may be cyclic, straight-chain or branched, General Formula (3):

a boron compound of (a)

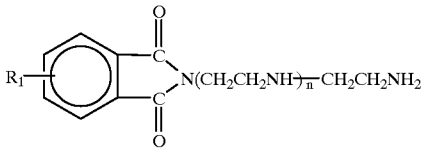

and/or a boron compound of (b)

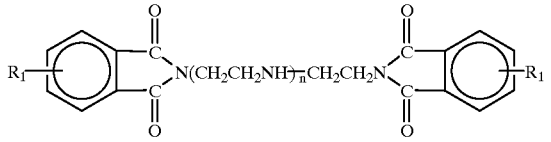

wherein, R is an alkyl or alkenyl group having a molecular weight of 80 to 4200 and carbon number of 6 to 300; l and n are each an integer of 1 to 4 and 0 to 15, respectively, and $(CH_2CH_2NH)_n$ may be cyclic, straight-chain or branched, and General Formula (4):

a boron compound of (a)

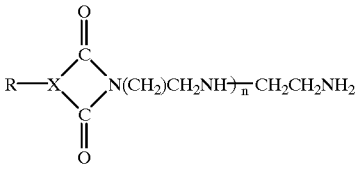

and/or a boron compound of (b)

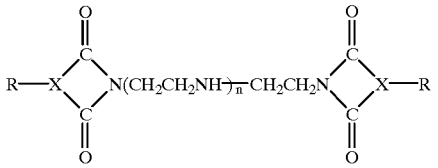

wherein, R is an alkyl or alkenyl group having a molecular weight of 80 to 4200 and carbon number of 6 to 300; X is $C_pH_{2p-1}$ or $C_pH_{2p-3}$; p and n are each an integer of 2 to 11 and 0 to 15, respectively; $(CH_2CH_2NH)_n$ may be cyclic, straight-chain or branched.

3. The lubricant oil composition of claim 2 wherein the boron is contained at a molar ratio of boron to nitrogen in the cyclic dicarboxylic acid imide of 0.005 to 1.

4. The lubricant oil composition of claim 3 wherein the boron to nitrogen ratio is 0.01 to 0.5.

* * * * *